US010405600B2

(12) United States Patent
Ferguson

(10) Patent No.: US 10,405,600 B2
(45) Date of Patent: Sep. 10, 2019

(54) ACCESSORIZABLE SHOE AND ACCESSORIES FOR THE SHOE

(71) Applicant: Beverly Ferguson, Cincinnati, OH (US)

(72) Inventor: Beverly Ferguson, Cincinnati, OH (US)

( * ) Notice: Subject to any disclaimer, the term of this patent is extended or adjusted under 35 U.S.C. 154(b) by 76 days.

(21) Appl. No.: 15/467,701

(22) Filed: Mar. 23, 2017

(65) Prior Publication Data

US 2017/0188654 A1 Jul. 6, 2017

Related U.S. Application Data

(62) Division of application No. 14/449,904, filed on Aug. 1, 2014, now abandoned.

(60) Provisional application No. 61/925,799, filed on Jan. 10, 2014, provisional application No. 61/861,810, filed on Aug. 2, 2013.

(51) Int. Cl.

| | |
|---|---|
| ***A43B 3/12*** | (2006.01) |
| ***A43B 3/24*** | (2006.01) |
| ***A43B 21/00*** | (2006.01) |
| ***A43B 13/14*** | (2006.01) |
| ***A43B 23/24*** | (2006.01) |

(52) U.S. Cl.

CPC ..... *A43B 3/242* (2013.01); *A43B 3/122* (2013.01); *A43B 3/244* (2013.01); *A43B 13/14* (2013.01); *A43B 21/00* (2013.01); *A43B 23/24* (2013.01)

(58) Field of Classification Search

CPC ..... A43B 3/122; A43B 3/242; A43B 21/00; A43B 3/18; A43B 3/22; A43B 3/20; A43B 3/166

USPC ..... 36/101, 136

See application file for complete search history.

(56) References Cited

U.S. PATENT DOCUMENTS

| | | | | | |
|---|---|---|---|---|---|
| 217,761 | A * | 7/1879 | Winn | A43B 3/20 | 36/7.2 |
| 985,780 | A * | 3/1911 | Clark | A43B 3/20 | 36/7.4 |
| 1,252,149 | A * | 1/1918 | Muse | A43B 23/28 | 36/58.5 |
| 1,385,328 | A * | 7/1921 | Loudenslager | A43C 11/22 | 2/245 |
| 1,471,035 | A * | 10/1923 | Keenan | A43B 1/0027 | 36/100 |
| 1,483,782 | A * | 2/1924 | Cole | A41D 17/00 | 36/2 R |
| 1,489,735 | A * | 4/1924 | Briggs | A43B 3/20 | 36/2 R |
| 1,655,715 | A * | 1/1928 | Sneeston | A43C 11/02 | 36/58.5 |

(Continued)

*Primary Examiner* — Katharine Gracz
(74) *Attorney, Agent, or Firm* — Cozen O'Connor

(57) ABSTRACT

A customizable combination shoe and accessory include: (a) a wearable mule or slide type shoe having: (i) a sole portion having an insole and an outsole, (ii) a vamp arranged at the insole, (iii) a heel affixed to the outsole, and (iv) a single anchor extending through the outsole; and (b) an accessory harness having: (i) a portion defining an opening, the opening being configured to engage the single anchor to removably secure the portion of the harness to the anchor at the outsole, and (ii) support portions, extending from the portion defining the opening, configured to engage portions of the foot of a wearer of the combination shoe and accessory to provide support to the engaged portions of the foot of the wearer.

7 Claims, 8 Drawing Sheets

(56) References Cited

U.S. PATENT DOCUMENTS 1,794,959 A * 3/1931 Howard ..... A43C 11/22 36/58.5
1,871,576 A * 8/1932 Argard ..... A43B 3/20 36/72 R
2,099,476 A * 11/1937 Glowka ..... A41D 17/00 36/2 R
2,153,968 A 4/1939 Loufbahn
2,183,277 A 12/1939 Heilhecker
2,233,544 A * 3/1941 McKinley ..... A43B 1/0036 359/519
2,368,314 A 5/1942 Marx
2,345,187 A 11/1942 Evans
2,406,975 A 9/1946 Walsh
2,420,618 A * 5/1947 Rabinovitz ..... A43B 3/16 36/2 R
2,434,064 A * 1/1948 Bredin ..... A41D 17/00 2/22
2,607,133 A 2/1950 Marlowe
2,625,753 A * 1/1953 Null ..... A43C 13/14 36/72 R
2,640,281 A * 6/1953 Murphy ..... A41D 17/02 36/2 R
2,651,117 A 9/1953 Harris
2,873,540 A * 2/1959 Murphy ..... A43B 3/24 36/101
3,000,116 A 9/1961 Ally
3,000,119 A * 9/1961 Altman ..... A43C 11/00 24/3.2
3,016,630 A 1/1962 Twiggs
3,034,231 A * 5/1962 Schwartz ..... A43B 3/20 36/7.2
3,073,042 A 1/1963 Deitch
3,570,147 A * 3/1971 Chiu ..... A43B 3/24 36/100
3,841,003 A * 10/1974 Huyge ..... A43B 3/122 36/11.5
3,925,915 A 12/1975 Colli
3,983,642 A * 10/1976 Liao ..... A43B 3/24 36/101
4,348,820 A 9/1982 D'Alessio
4,447,968 A * 5/1984 Spademan ..... A43B 5/00 36/109
4,811,501 A * 3/1989 Okayasu ..... A43C 13/14 36/77 R
5,191,505 A * 3/1993 Gordon ..... A61N 1/14 361/223
5,251,386 A 10/1993 Diaz
5,410,821 A * 5/1995 Hilgendorf ..... A43B 1/0081 36/100
5,477,625 A * 12/1995 Goldsmith ..... A43B 1/0054 36/100
D378,470 S * 3/1997 McDaniel ..... D2/909
D384,495 S 10/1997 Watson
5,855,078 A * 1/1999 Starker ..... A43B 5/145 36/131
5,894,684 A * 4/1999 Sand ..... A43B 7/20 36/115
5,992,058 A 11/1999 Jneid
6,007,506 A * 12/1999 Heil ..... A43B 7/20 602/23
6,038,792 A * 3/2000 Halter ..... A43B 5/02 36/133
6,345,454 B1 * 2/2002 Cotton ..... A43B 3/24 36/101
6,418,643 B1 * 7/2002 Yang ..... A43B 3/0078 36/101
D492,474 S * 7/2004 Branstrom ..... D2/916
6,789,334 B2 9/2004 Wu
D557,483 S * 12/2007 Young ..... D2/946
7,398,607 B1 * 7/2008 Garcia ..... A43B 1/0072 36/101
7,428,787 B2 * 9/2008 Crowley, II ..... A41D 17/005 36/1.5
7,464,487 B2 12/2008 Boyd
D594,220 S * 6/2009 McDaniel ..... D2/971
8,001,706 B2 * 8/2011 Jeffers ..... A43B 3/0078 2/239
D664,332 S * 7/2012 Garcia Mira ..... D2/925
D667,613 S * 9/2012 Gordon ..... D2/915
2002/0194750 A1 * 12/2002 Feick ..... A43B 3/122 36/101
2003/0088996 A1 * 5/2003 Hall ..... A43B 3/0078 36/2 R
2003/0145490 A1 * 8/2003 Tsai ..... A43B 3/122 36/15
2004/0226194 A1 * 11/2004 Schenone ..... A43B 3/0078 36/112
2005/0011087 A1 * 1/2005 Stevens ..... A43B 3/0078 36/136
2005/0235522 A1 * 10/2005 Crowley, II ..... A41D 17/005 36/2 R
2006/0032091 A1 * 2/2006 Kilgore ..... A43B 9/00 36/68
2006/0053661 A1 * 3/2006 van Duyne ..... A43B 3/24 36/100
2006/0150441 A1 * 7/2006 Cody, Jr. ..... A43B 3/122 36/42
2006/0156586 A1 * 7/2006 Brunelle-Wright .... A43B 3/122 36/89
2006/0230637 A1 * 10/2006 Kipnes ..... A43B 3/24 36/94
2007/0017126 A1 * 1/2007 Kipnes ..... A43B 3/24 36/101
2007/0240336 A1 * 10/2007 Richardson ..... A43B 1/0054 36/101
2008/0010866 A1 * 1/2008 Mallamohamad ..... A43B 3/102 36/136
2008/0235989 A1 * 10/2008 Agrawaz ..... A43B 3/0078 36/89
2008/0271343 A1 11/2008 Ordenes Haag
2009/0193684 A1 8/2009 Diamond
2011/0225850 A1 * 9/2011 Shen ..... A43B 3/126 36/136
2011/0252581 A1 * 10/2011 Teichert ..... A43B 3/16 12/146 R
2011/0283564 A1 11/2011 Stillwagon
2012/0030866 A1 * 2/2012 Snider-Tornetta ... A43B 1/0054 2/455
2012/0042544 A1 * 2/2012 Leo ..... A43B 23/24 36/136
2012/0216429 A1 * 8/2012 Bastida ..... A43B 3/122 36/25 R
2014/0000127 A1 * 1/2014 Tang ..... A43B 3/244 36/101
2014/0259763 A1 * 9/2014 Rady ..... A43B 21/00 36/58.5
2015/0040434 A1 * 2/2015 Perkins ..... A43B 1/0054 36/101
2016/0015117 A1 * 1/2016 Kizer ..... A43B 3/122 36/11.5
2016/0338448 A1 * 11/2016 Kenison ..... A43B 23/227
2017/0099912 A1 * 4/2017 Kenison ..... A43B 3/122

* cited by examiner

ACCESSORIZABLE SHOE AND ACCESSORIES FOR THE SHOE

CROSS-REFERENCE TO RELATED APPLICATIONS

This application is a divisional of U.S. patent application Ser. No. 14/449,904 which was filed with the U.S. Patent and Trademark Office on Aug. 1, 2014. This application claims the benefit of U.S. Provisional Patent Application Nos. 61/861,810, filed on Aug. 2, 2013, and 61/925,799, filed on Jan. 10, 2014, both entitled "ACCESSORIES FOR SHOES", each of which is hereby incorporated by reference in their entirety.

FIELD OF THE INVENTION

The present invention is directed to a combination of a shoe and shoe accessory for converting a sandal or mule-style shoe into a shoe having a back portion for receiving a wearer's heel.

BACKGROUND OF THE INVENTION

Shoes having detachable components are known. U.S. Pat. No. 2,607,133 to Marlowe et al. teaches a shoe consisting of a body portion to which an upper is attached to form the completed shoe. The upper is detachably secured to the body portion by plural brackets that fit over the lower surfaces of the upper and secure the upper to the body portion. However, while Marlowe et al. permits different types of shoes to be formed, neither the base portion nor the upper form a stand-alone shoe. That is, until the body portion and the upper are affixed to one another, no wearable shoe exists. Moreover, the attachment method is complex and requires the use of multiple brackets for forming the completed shoe.

U.S. Patent Publication No. 2011/0283564 filed by Stillwagon teaches a shoe with interchangeable tops. A shoe base is provided with multiple fasteners around its periphery to which eyelets of the upper are engaged to form a shoe. Alternatively, engageable portions of a zipper are arranged on the outer portions of the shoe base and the interchangeable tops. However, while Stillwagon permits different types of shoes to be formed, the shoe base is not a stand-alone shoe. That is, just as in Marlowe et al., until the shoe base and the upper are affixed to one another, no wearable shoe exists. Moreover, the attachment method is complex and requires the use of multiple fasteners or a zipper for forming the completed shoe.

U.S. Pat. No. 2,368,314 to Marx shows a shoe having a separable sole and upper. In Marx, a sole portion is provided with a series of anchoring members that project upward to form a channel. The upper is secured to the sole portion by thickened portions of the uppers into respective channels in the sole portion formed by the anchoring members. However, while Marx permits different types of shoes to be formed, the sole portion is not a stand-alone shoe. That is, just as in Marlowe et al. and Stillwagon, until the sole portion and the upper are affixed to one another, no wearable shoe exists. Moreover, the attachment method is complex and requires the use of complex anchoring mechanisms for forming the completed shoe.

U.S. Pat. No. 2,345,187 to Evans shows a shoe having a separable sole and upper. The upper is formed with a flange or a band around its lower periphery. The flange of the upper is configured to engage around a significant portion of the sole with complementary shaped sole flanges. However, while Evans permits different types of shoes to be formed, the sole is not a stand-alone shoe. That is, just as in Marlowe et al., Stillwagon and Marx, until the sole portion and the upper are affixed to one another, no wearable shoe exists. Moreover, the attachment method in Evans is complex and requires the use of complex anchoring mechanisms in both the upper and the sole for forming the completed shoe.

The above conventional shoes with detachable portions have a disadvantage in that none of the individual components functions as a working shoe without attachment of the constituent parts to one another. Moreover, the attachment structure of the conventional shoes of this type is complex and requires providing, and the user manipulating, structure that is disposed over a significant area of the constituent parts of the shoe.

SUMMARY OF THE INVENTION

It is therefore an object of the invention to provide a combination of a functioning, e.g., mule style, shoe and an accessory, the shoe being structured so as to be customizable by engagement, by a single anchor on the shoe, to the accessory.

In accordance with a first aspect of the present invention, a customizable combination shoe and accessory include: (a) a wearable mule or slide type shoe having: (i) a sole portion having an insole and an outsole, (ii) a vamp arranged at the insole, (iii) a heel affixed to the outsole, and (iv) a single anchor extending through the outsole; and (b) an accessory harness having: (i) a portion defining an opening, the opening being configured to engage the single anchor to removably secure the portion of the harness to the anchor at the outsole, and (ii) support portions, extending from the portion defining the opening, configured to engage portions of the foot of a wearer of the combination shoe and accessory to provide support to the engaged portions of the foot of the wearer.

In another aspect, the single anchor comprises an outer anchor portion, arranged at an outer portion of the outsole, having a recessed head comprising a female connection, and an inner anchor portion, arranged at an inner portion of the outsole, having a shaft with male threading, the female connection being configured to receive the male threading to form the single anchor.

In another aspect, the insole comprises a base portion adjacent to the outsole.

In another aspect, the outsole has a hole, and the inner anchor portion engages the outer anchor portion through the hole such that the outsole is clamped between the inner anchor portion and the outer anchor portion when the male threading and the female connection are engaged with one another.

In another aspect, the insole further comprises a lining, arranged above the base insole in the direction of the wearer's foot, the lining and the base insole being configured to cover the inner anchor portion of the assembled anchor so that the inner anchor portion is not visible from the top of the shoe and cannot be felt by the wearer of the shoe.

In another aspect, a bottom peripheral portion of the vamp is sandwiched between the base insole and the outsole to secure the vamp to the shoe.

In another aspect, the support portions of the accessory harness comprise side straps, extending from the portion defining the opening, configured to provide support to the side of the wearer's foot.

In another aspect, the support portions further comprise a heel strap extending from the side straps toward the heel, and a buckled instep strap, extending from the side straps toward the toe.

In another aspect, the support portions of the accessory harness further comprise a kilt having a fringed lower portion and a channel at a top portion, the channel being configured to be supported on the instep strap.

In accordance with another aspect of the present invention, a method is provided of making a shoe and accessory having: (a) a wearable mule or slide type shoe having: (i) a sole portion having an insole and an outsole, the insole having a base insole immediately adjacent to the outsole, (ii) a vamp arranged at the insole, (iii) a heel affixed to the outsole, and (iv) a single anchor extending through the outsole; and (b) an accessory harness having: (i) a portion defining an opening, the opening being configured to engage the single anchor to removably secure the portion of the harness to the anchor at the outsole, and (ii) support portions, extending from the portion defining the opening, configured to engage portions of the foot of a wearer of the combination shoe and accessory to provide support to the engaged portions of the foot of the wearer, the single anchor having an outer anchor portion, arranged at an outer portion of the outsole, having a recessed head comprising a female connection, and an inner anchor portion, arranged at an inner portion of the outsole, having a shaft with male threading. The method includes: clamping the outsole by threadingly engaging the female connection of the outer anchor portion with the threaded shaft of the inner anchor portion to form the single anchor; and applying a pushing force to the portion of the accessory harness defining the opening to urge the anchor through the opening of the accessory harness to form the shoe and accessory.

In another aspect, the insole further has a lining layer, and the method further includes, after the step of clamping, applying the lining layer over the base insole to cover the inner anchor portion so that it is not visible.

In accordance with yet another aspect of the present invention, a customizable wearable shoe, removably engagable with an accessory harness having a portion defining an opening, includes: (i) a sole portion having an insole and an outsole, (ii) a vamp arranged at the insole, (iii) a heel affixed to the outsole, and (iv) a single anchor extending through the outsole, the anchor being configured to removably engage the opening of the accessory harness.

In another aspect, the single anchor comprises an outer anchor portion, arranged at an outer portion of the outsole, having a recessed head comprising a female connection, and an inner anchor portion, arranged at an inner portion of the outsole, having a shaft with male threading, the female connection being configured to receive the male threading to form the single anchor.

In another aspect, the insole comprises a base portion adjacent to the outsole.

In another aspect, the outsole has a hole, and the inner anchor portion engages the outer anchor portion through the hole such that the outsole is clamped between the inner anchor portion and the outer anchor portion when the male threading and the female connection are engaged with one another.

In another aspect, the insole further comprises a lining, arranged above the base insole in the direction of the wearer's foot, the lining and the base insole being configured to cover the inner anchor portion of the assembled anchor so that the inner anchor portion is not visible from the top of the shoe and cannot be felt by the wearer of the shoe.

In another aspect, a bottom peripheral portion of the vamp is sandwiched between the base insole and the outsole to secure the vamp to the shoe.

In accordance with still another aspect of the present invention, an accessory for connecting to a shoe, the shoe having a sole portion having an insole and an outsole, a vamp arranged at the insole, a heel affixed to the outsole, and a single anchor extending through the outsole, has: a portion defining an opening, the opening being configured to engage the single anchor to removably secure the portion of the harness to the anchor at the outsole to connect the accessory to the shoe, and support portions, extending from the portion defining the opening, configured to engage portions of the foot of a wearer of the connected shoe and accessory to provide support to the engaged portions of the foot of the wearer.

BRIEF DESCRIPTION OF THE DRAWINGS

The above and/or other aspects and advantages will become more apparent and more readily appreciated from the following detailed description of the disclosed embodiments taken in conjunction with the accompanying drawings in which.

DETAILED DESCRIPTION OF THE PRESENTLY PREFERRED EMBODIMENTS

Figure 1:
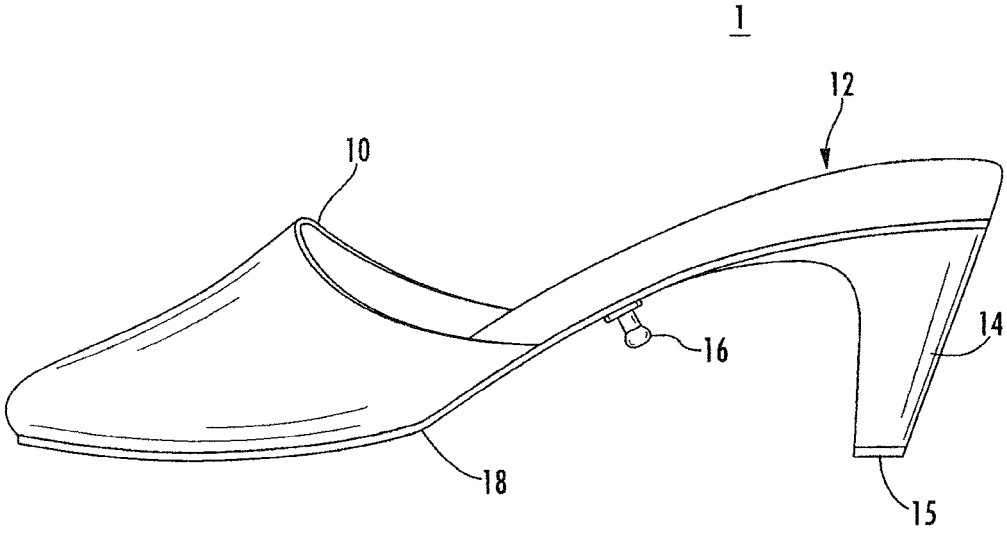
FIG. 1 is a side elevation view of a mule style shoe configured to be customizable by engaging a harness accessory, in accordance with an embodiment of the present invention.

In the following description, like elements will be referred to using like reference numerals.

The present invention is directed to a combination of a wearable shoe, for example, a sandal, mule, or slide style shoe, and a shoe accessory for converting the wearable shoe into a shoe having additional structure for supporting another part of the foot, for example, a back portion for receiving a wearer's heel and/or the instep of the wearer.

An advantage of such a construction is that the consumer can be provided with a shoe accessory, which can be sold with the shoe or separately as an add-on, to be secured to and removed from a completed mule or backless-type shoe. The accessory gives the consumer an opportunity to customize the shoe style by changing it from a basic wearable style to a variety of other styles depending on the shoe accessory.

The accessory can be marketed as a "giveaway with purchase", "pay with purchase", or sold separately. For example, when the consumer purchases the mule (one pair) and three accessories she is paying for one pair of mules but is getting four different shoe styles with one basic pair of shoes. In other words, by virtue of the present invention, an existing pair of wearable mules, for example, can be modified by adding a particular accessory to the shoe.

In the preferred embodiments disclosed herein, the shoe is a standard-type of wearable shoe, namely having a standard construction including a heel portion and a toe portion, but includes a single anchor to which regions of the harness or accessory can be releasably and removably secured to the shoe.

The invention will first be described in relation to a simple mule design. As will be developed below, the type of shoe that can be used is not limited to a mule. FIG. 1 shows an accessorizable mule style shoe 1 having a vamp 10, an insole 12, a heel 14 having a top piece 15, and a single anchor 16 affixed at a shank region of the outsole 18.

During normal use of the shoe 1, the wearer slips the toes of her foot into the vamp 10, which provides support against the foot sliding too far forward. Mules, as is well known in the art, provide support only to the bottom of the foot, in addition to constraining forward motion of the toe portion of the foot. As will be discussed in greater detail below, in the shoe 1 as it is shown in FIG. 1, i.e., without any accessory, the anchor 16 performs no function in the shoe 1. However, the presence of the anchor 16 allows it to be used to affix one or more types of accessories to the shoe 1 at the outsole, to provide additional support to other parts of the user's foot and change the style of the shoe.

Figure 2:
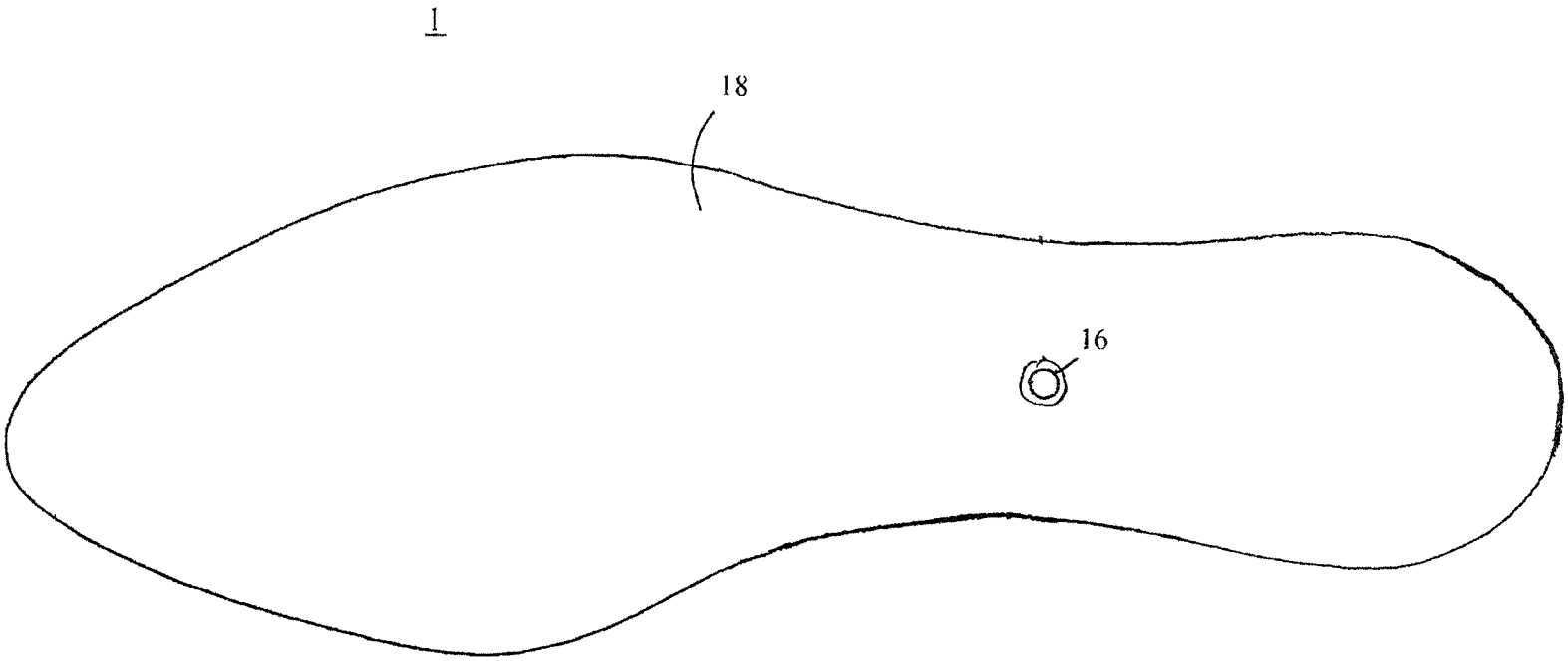
FIG. 2 is a bottom view of the mule style shoe shown in FIG. 1.

FIG. 2 is a bottom view of the shoe 1 shown in FIG. 1, showing the outsole 18 and the anchor 16 affixed thereto at a shank portion of the shoe 1. In a preferred embodiment, the anchor 16 can be a stud having an enlarged head, e.g., in the shape of a ball, which will allow a portion of a harness of an accessory, to be described in more detail below, to be seated thereon in a secure manner such that the harness will not readily release from the anchor 16 without intended user action.

Figure 3:
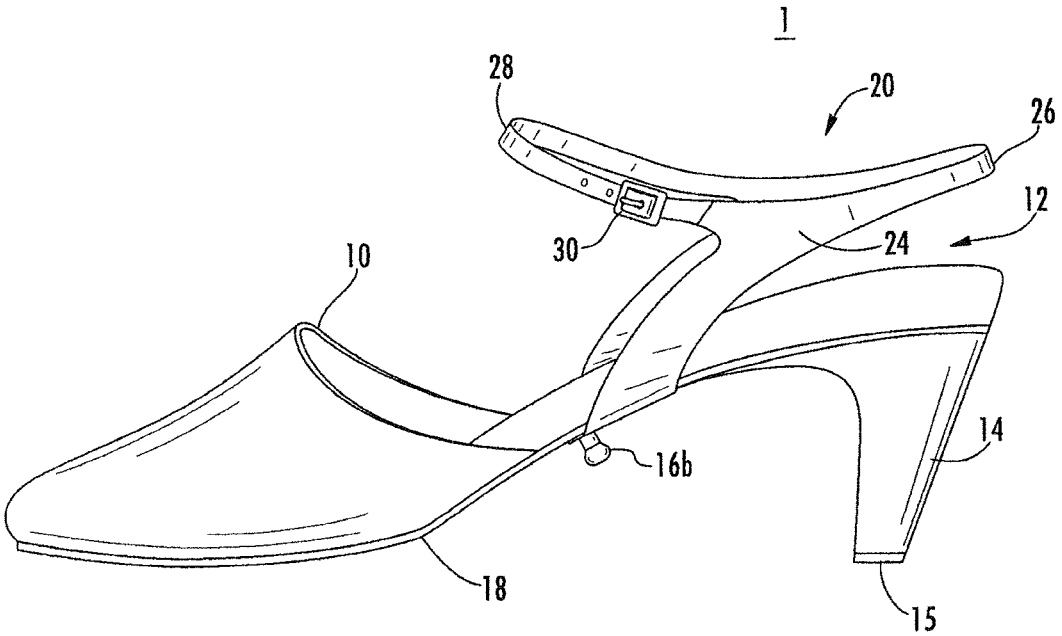
FIG. 3 is a side elevation view of the mule style shoe shown in FIG. 1 and a harness in accordance with an embodiment of the present invention.
Figure 4:
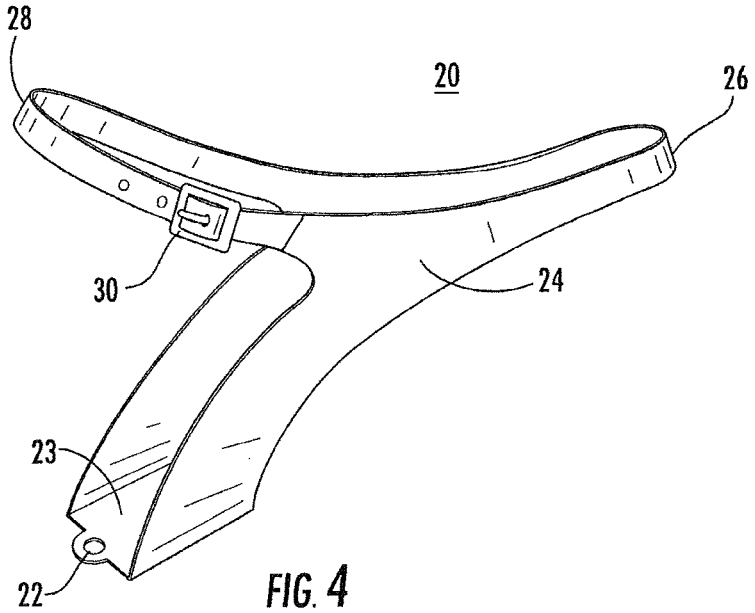
FIG. 4 is a side elevation view of the harness shown in FIG. 3.

An exemplary accessory or harness 20 is shown attached to the shoe 1 in FIG. 3, and separately from the shoe 1 in FIG. 4. As can be seen in these figures, the harness 20 has an eyelet or window 22 dimensioned to releasably and securely receive the anchor 16.

In the illustrated embodiment, the harness 20 is configured as a strap of leather or other known material having ends that are connectable about a wearer's ankle via a fastener such as a buckle or the like. In particular, the harness 20 has a center portion 23, which includes the window 22 formed therein. To secure the harness 20 to the shoe 1, a pushing force is applied to the center portion 23 to urge the anchor 16 through the window 22. Once the connection is made, the anchor 16 keeps the harness 20 securely fit to the shoe 1 and prevents unwanted detachment. The harness 20 can be made in leather, plastic, counter stock and any material. Also, as the harness 20 is detachable, it can be packaged separately from packaging for the shoe, for example in a see-through type packaging, if desired.

The harness 20 includes, in addition to the window 22 and the center portion 23, side support portions 24, which provide support to the sides of the foot of the wearer. A heel strap portion 26 extends from the side support 24 and provides support to the back of the heel of the wearer, inhibiting the foot from sliding out of the back of the shoe 1. An instep strap 28 and a buckle 30 engage one another to secure the accessorized shoe around the instep of the foot, to provide the function normally provided in a conventional buckled shoe. That is, the side support portions 24, the heel strap portion 26, and the instep strap 28 and buckle 30, cooperate to provide support around the ankle of the wearer.

Figure 5:
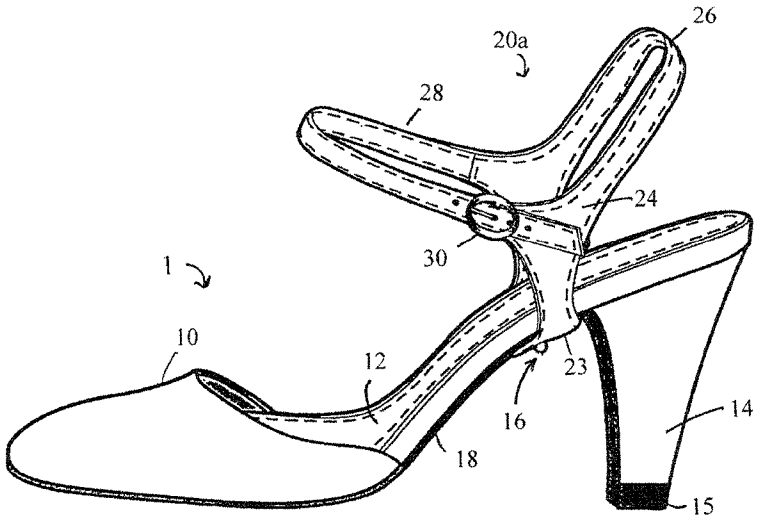
FIGS. 5 and 6 show a harness in accordance with another embodiment of the present invention, affixed to a mule style shoe and a slide style shoe, respectively.
Figure 6:
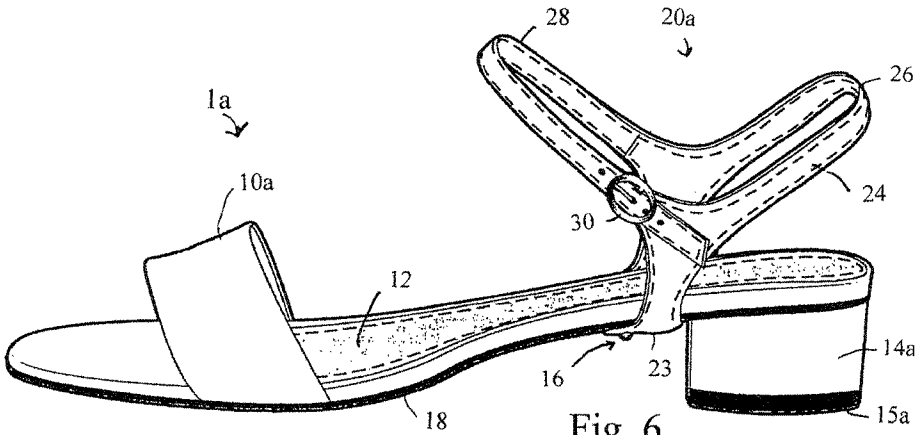

FIGS. 5 and 6 illustrate a harness 20*a*, having a different shape than harness 20 shown in FIGS. 3 and 4, but having an identical function. Corresponding portions of the harness 20*a* are indicated by the same reference numerals as used in FIGS. 3 and 4. In FIG. 5 the harness 20*a* is illustrated with a mule type of shoe 1, of the type shown in FIGS. 1 to 3.

In FIG. 6, the harness 20*a* is shown with a slide type of shoe 1*a*. A slide style is essentially a mule style with an open toed vamp 10*a*. Another difference in the illustrated slide shoe 1*a* is the use of a lower heel 14*a* and corresponding top piece 15*a*.

Figure 7:
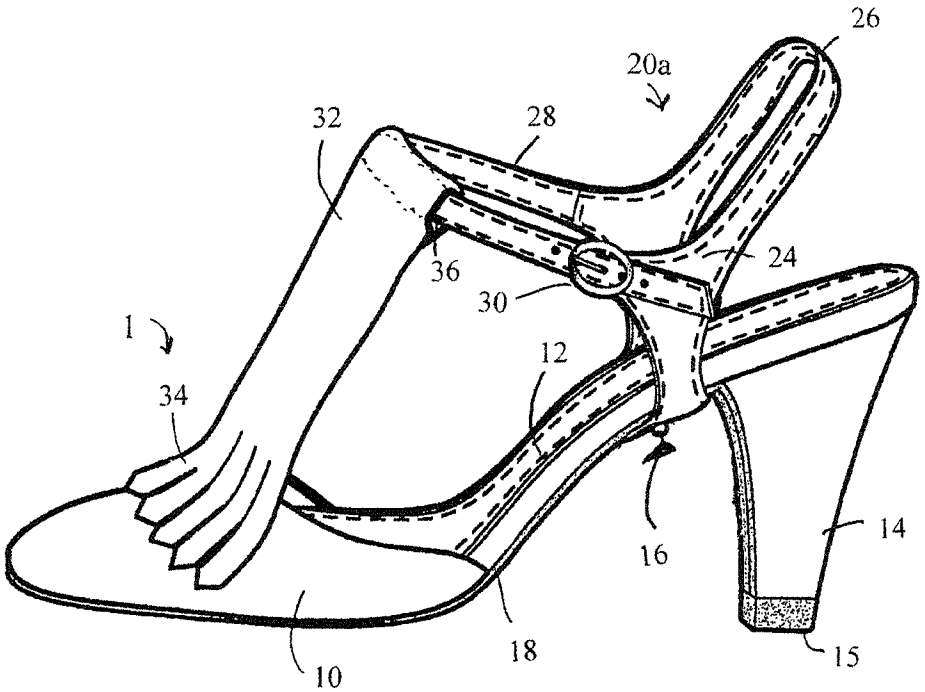
FIG. 7 shows the mule style shoe and harness shown in FIG. 5, with an additional T-strap kilt affixed to the harness.

FIG. 7 illustrates an additional accessory, a T-strap kilt 32, that can be added to the harness 20*a* to provide a fashionable front piece with a fringed bottom portion 34. In the illustrated embodiment, only the top portion of the T-strap kilt 32 is attached to the harness 20*a*. The lower fringed portion 34 is loose and simply rests on the vamp 10. The T-strap kilt 32 is folded and sewn at its top portion for form a channel 36. To attach the T-strap kilt 32 to the harness 20*a*, the user simply slips the strap 28 through the channel before buckling the shoe, providing the additional fashionable accessory to the shoe. Alternatively, a hook/loop fastener or other fastener, such as snaps, can be used to attach the kilt 32 about the strap 28 and form the channel.

As would be recognized by those of skill in the art, although the T-strap kilt 32 is shown with reference to the harness 20*a*, it is also usable with the harness 20 shown in FIGS. 3 and 4 in precisely the manner described above.

The harness can be designed in various styles, decor, color, materials and trimmings. By offering such various styles and configurations, a standard or basic mule shoe can be accessorized to convert the mule into any number of shoe styles simply by attaching or replacing one accessory for another.

As can be seen from the foregoing examples, the wearable shoe having a single anchor in the shank portion of the outsole allows a user to create a number of fashionable shoes using a simple connection and disconnection method with multiple harnesses, at a single point on the shoe, while still having a basic shoe that can be worn even without attachment of any harness accessory. Based on the use of the simple mule or slide type shoe as the base shoe, a shoe can be provided in which accessories can be added that provide additional support to different areas of the foot, as well as providing aesthetically pleasing structure to the shoe.

In one embodiment, as shown with reference to FIGS. 8-12 the anchor 16 comprises an inner anchor portion 16*a* and an outer anchor portion 16*b*. The inner anchor portion 16*a* is, during construction of the shoe, inserted into hole 19 formed in the outsole 18 from the top, i.e., from the direction of the user's foot. As can be seen in the exploded view of FIG. 8, the insole 12 is of multi-layer construction, including, from bottom to top, the base insole 12*a*, preferably made of a relatively thick piece of leather or other strong material, and a liner 12*b*, which presents a smooth surface to the sole of the wearer's foot. The liner 12*b* is preferably made of a smooth material, such as soft leather or similar synthetic material, to ensure comfort to the wearer's foot. Optionally, a rigid shank (not shown) may be arranged within the layer structure of the insole to provide additional rigidity to the base of the shoe by stiffening the insole 12. Such a shank is preferably made of a rigid yet lightweight material such as metal, plastic or composite.

Figure 8:
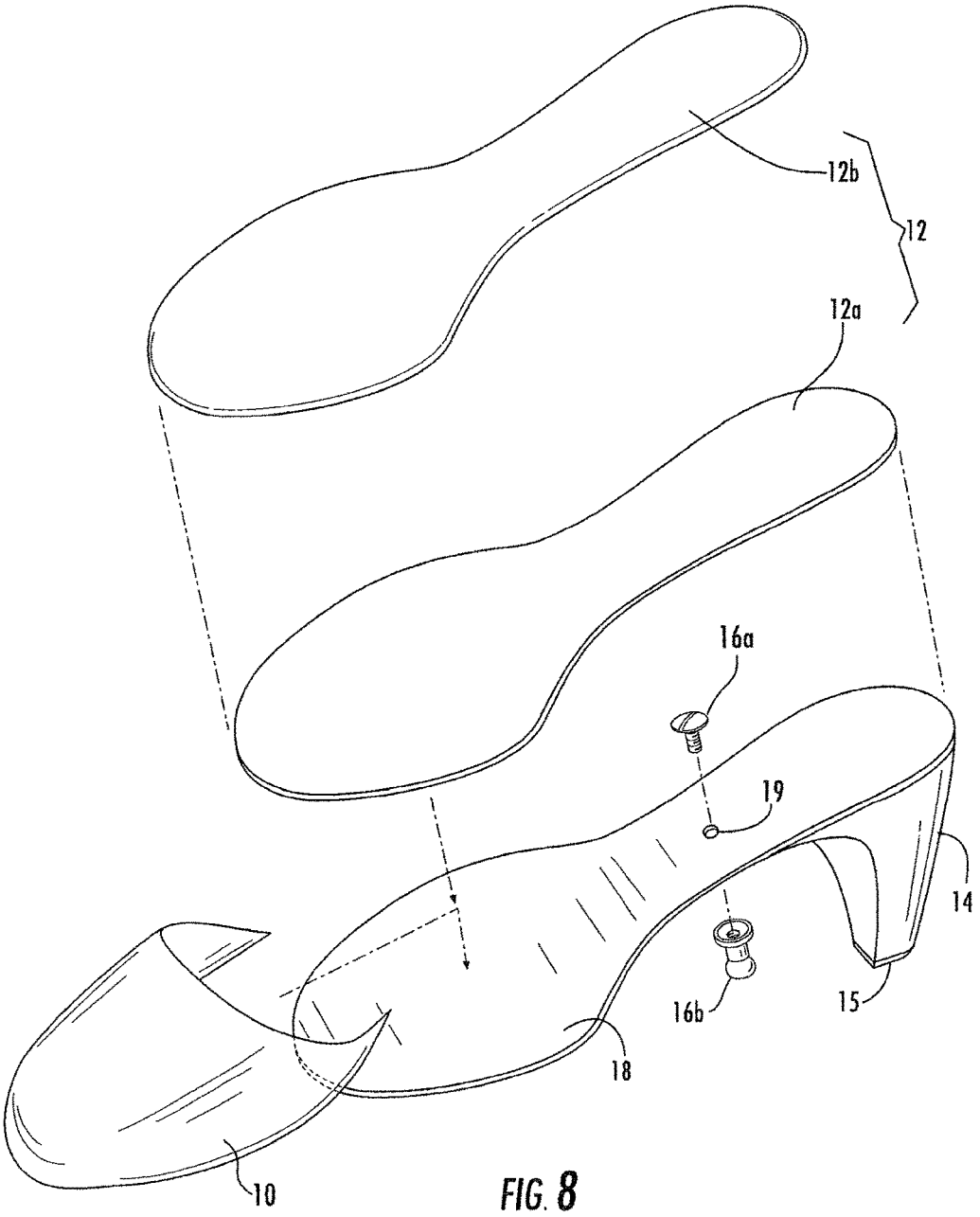
FIG. 8 is an exploded view showing the component parts of the shoe shown in FIG. 1.

As can also be seen in FIG. 8, the vamp 10 is secured to the insole 12 by wrapping material at a lower periphery of the vamp 10 so as to tuck it under the insole 12 as is known in the art. Once the outsole 18 is affixed, e.g., glued, to the insole, the vamp 10 is securely fastened to the shoe by being sandwiched between the insole 12 and the outsole 18.

In a preferred embodiment, the inner anchor portion 16*a* comprises a flat top portion and a shaft extending from the flat top portion. The shaft is preferably provided with spiral male threading, of the type capable of engaging with a counterpart structure having female threading. In one embodiment, during assembly of the shoe 1, the shaft of the inner anchor portion 16*a* is pushed or otherwise inserted down through hole 19 in the outsole 18 and extends through the hole 19 in the outsole 18, whereupon the anchor portion 16*b* is attached.

Figure 9:
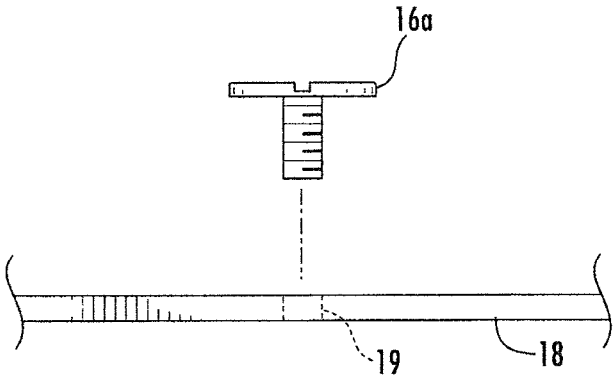
FIG. 9 is an exploded partial view of an inner anchor portion prior to engagement with the outsole of the shoe in accordance with an embodiment of the present invention.
Figure 10:
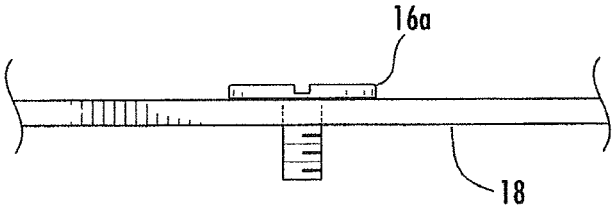
FIG. 10 shows the inner anchor portion engaging the outsole of the shoe in accordance with an embodiment of the present invention.
Figure 11:
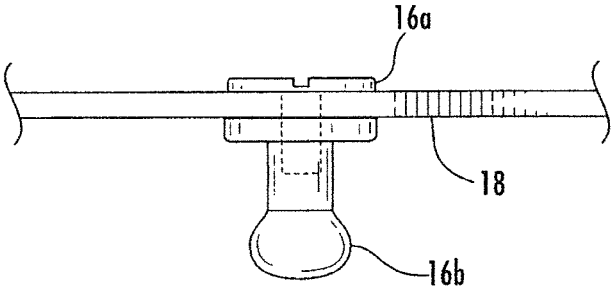
FIG. 11 shows the inner anchor portion and outer anchor portion clamping the outsole of the shoe in accordance with an embodiment of the present invention.

FIG. 9 is an exploded partial view of the inner anchor portion 16*a* and the outsole 18 prior to their engagement. FIG. 10 shows the inner anchor portion 16*a* having been pushed through the hole 19 in the outsole 18. The shaft of the inner anchor portion 16*a* thus engages hole 19 in the outsole 18.

Figure 12:
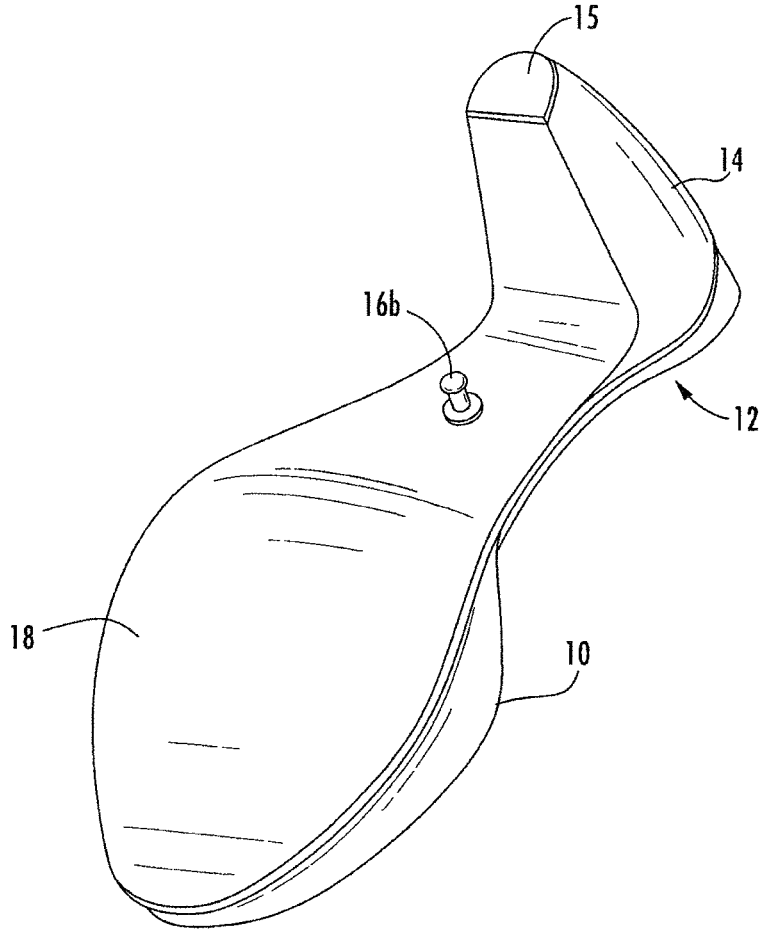
FIG. 12 is a view of the anchor protruding from the outsole of the shoe in accordance with an embodiment of the present invention.

As described above, FIG. 10 shows the shaft of the inner anchor portion 16*a* having passed through the hole 19 of the outsole 18. Next, the outer anchor portion 16*b*, which has female threading at a top portion thereof, is screwed onto the shaft of the inner portion 16*a* to form the anchor 16 (see FIG. 11). As can be seen in FIG. 12, the bottom of the assembled shoe has the outer portion 16*b* of the anchor 16 protruding from the outsole 18 in a direction away from that of the wearer's foot. This anchor 16 permits an accessory harness 20 to be affixed to the shoe 1 in the manner described above.

While the foregoing description refers to the inner portion 16*a* as first being inserted, the process need not be performed in this order. In an alternative manner of installing the anchor 16, the top portion of the outer anchor portion 16*b*, having the female threading, can instead first be pushed from below to extend out of the top of the outsole 18. Then male threading on the shaft of the inner portion 16*a* can be screwed into the female threaded portion of the outer portion 16*b* that protrudes through the outsole 18.

In either case, in order to ensure a permanent connection of the portions 16*a* and 16*b* of the anchor 16, it is preferable to previously insert, for example into the female threading, and/or on the male threaded shaft, an adhesive material, such as a thread locking compound, that, when set, prevents the engaged male and female threads from disengaging with one another. While the disclosed embodiment illustrates the use of spiral threading for engagement between the shaft of the anchor portions 16*a* and 16*b*, any other method of engagement may be used.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A customizable combination shoe and accessory, comprising:

(a) a wearable mule or slide type shoe having:

(i) a sole portion having an insole and an outsole, (ii) a vamp arranged at the insole, (iii) a heel affixed to the outsole, and (iv) only a single anchor, the single anchor extending through the outsole, the single anchor comprising:

an outer anchor portion, arranged at an outer portion of the outsole, having a cylindrical portion with a first end extending from the outer portion of the outsole, and a second end, and further comprising a bulbous head at the second end, and an inner anchor portion, arranged at an inner portion of the outsole, wherein the inner anchor portion and the first end of the cylindrical portion are configured to engage, through a hole in the sole portion, with each other;

the insole comprising:

a base portion adjacent to the outsole, and a lining, arranged above the base portion of the insole in the direction of a wearer's foot, wherein one of the lining and base portion of the insole is configured to cover the inner anchor portion of the assembled single anchor; and (b) an accessory harness having:

(i) a portion defining an opening, the opening being configured to engage the single anchor to removably secure the portion of the harness to the anchor at the outsole, and (ii) support portions, extending from the portion defining the opening, configured to engage portions of the foot of a wearer of the combination shoe and accessory to provide support to the engaged portions of the foot of the wearer.

2. The combination of claim 1, wherein the outer anchor portion has a recessed head comprising a female connection, and the inner anchor portion has a shaft with male threading, the female connection being configured to receive the male threading to form the single anchor.

3. The combination of claim 2, wherein the inner anchor portion engages the outer anchor portion through the hole such that the outsole is clamped between the inner anchor portion and the outer anchor portion when the male threading and the female connection are engaged with one another.

4. The combination of claim 2, wherein a bottom peripheral portion of the vamp is sandwiched between the base insole and the outsole to secure the vamp to the shoe.

5. The combination of claim 1, wherein the support portions of the accessory harness comprise side straps, extending from the portion defining the opening, configured to provide support to the side of the wearer's foot.

6. The combination of claim 5, wherein the support portions further comprise a heel strap extending from the side straps toward the heel, and a buckled instep strap, extending from the side straps toward the toe.

7. The combination of claim 6, wherein the support portions of the accessory harness further comprise a kilt having a fringed lower portion and a channel at a top portion, the channel being configured to be supported on the instep strap.

* * * * *